US006988526B2

(12) United States Patent
Judkins

(10) Patent No.: US 6,988,526 B2
(45) Date of Patent: Jan. 24, 2006

(54) ROMAN SHADE WITH LINER

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 10/774,555

(22) Filed: Feb. 9, 2004

(65) Prior Publication Data

US 2004/0154754 A1 Aug. 12, 2004

Related U.S. Application Data

(60) Provisional application No. 60/445,862, filed on Feb. 10, 2003.

(51) Int. Cl.
*E06B 9/48* (2006.01)

(52) U.S. Cl. ..... 160/84.01; 160/84.05

(58) Field of Classification Search ..... 160/84.01, 160/84.04, 84.05, 123, 113, 114, 115, 330, 160/348, 84.08, 84.03
See application file for complete search history.

(56) References Cited

U.S. PATENT DOCUMENTS 3,042,111 A 7/1962 Wytovich
D277,061 S 1/1985 Picoy
4,928,743 A * 5/1990 Wojtysiak ..... 160/84.01
5,205,333 A * 4/1993 Judkins ..... 160/84.02
RE34,273 E * 6/1993 Phillips et al. ..... 160/84.01
5,787,951 A 8/1998 Tonomura et al.
6,662,845 B1 * 12/2003 Palmer ..... 160/84.01

* cited by examiner

*Primary Examiner*—Blair M. Johnson
(74) *Attorney, Agent, or Firm*—Buchanan Ingersoll PC

(57) ABSTRACT

A roman shade with liner has a headrail, a bottom bar spaced apart from and parallel to the headrail and both a face material and a liner extending from the headrail and attached to the bottom bar. A plurality of lift cords are attached to the bottom bar, pass through the gap between the liner and the face material and extend into the headrail. Each lift cord engages a set of tabs, rings or other one cord connectors attached to the inside surface of the face material. Preferably, each lift cord also engages cord connectors on the inside surface of the liner. The face material and the liner are each a material that will form loops that extend below the bottom bar as the bottom bar is raised. The face material and liner are sized and configured so that no loop of face material will extend beyond at least one loop of liner material. Consequently, the liner will block sunlight from the face material when the shade is fully raised or partially raised. The face material and liner preferably are attached to the headrail by inserts that are removable from the headrail. A line of magnets may be provided along each side edge of the liner with a lift cord positioned behind each line of magnets.

16 Claims, 6 Drawing Sheets

FIG. 4
PRIOR ART
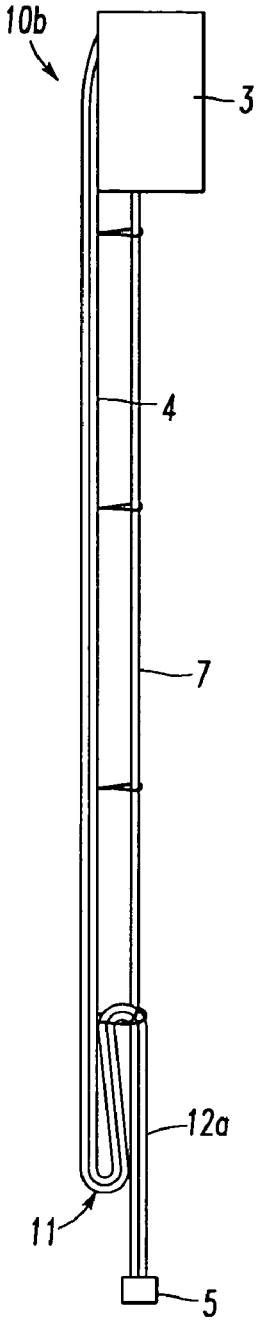
FIG. 5
PRIOR ART
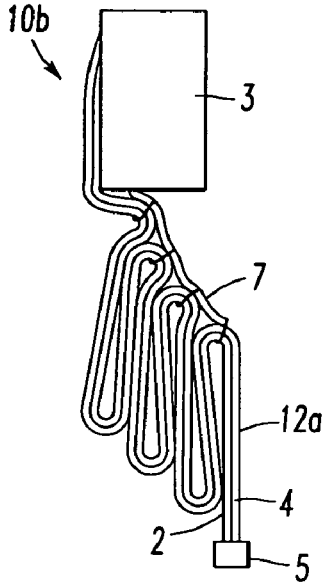
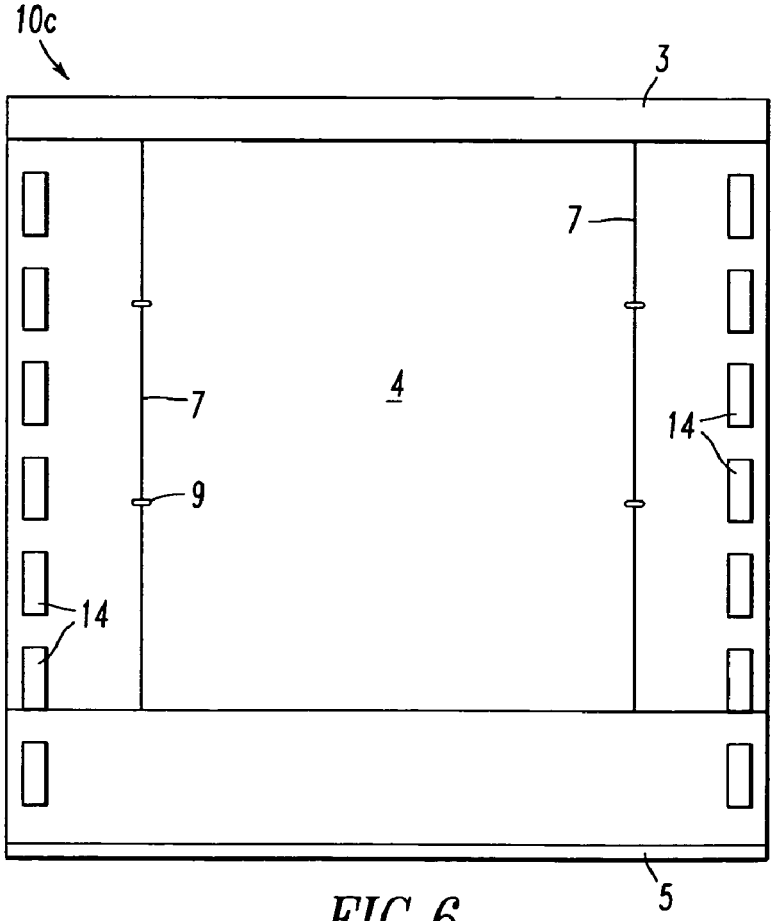
FIG. 6
PRIOR ART FIG. 9
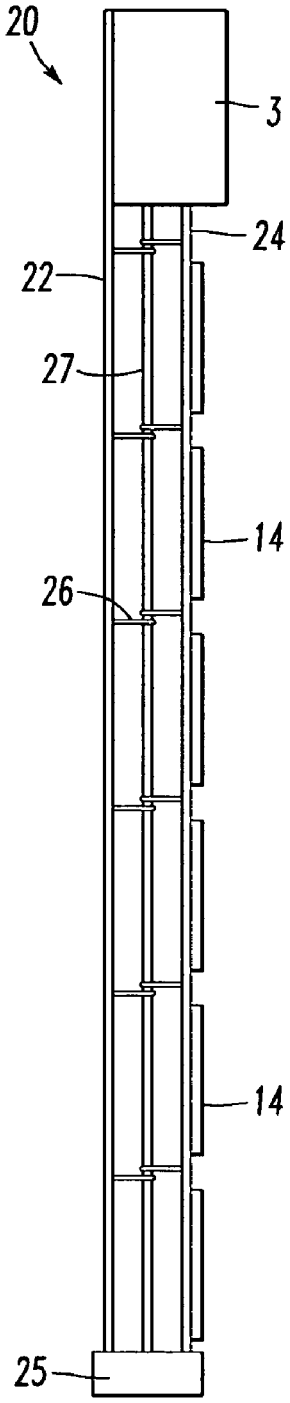
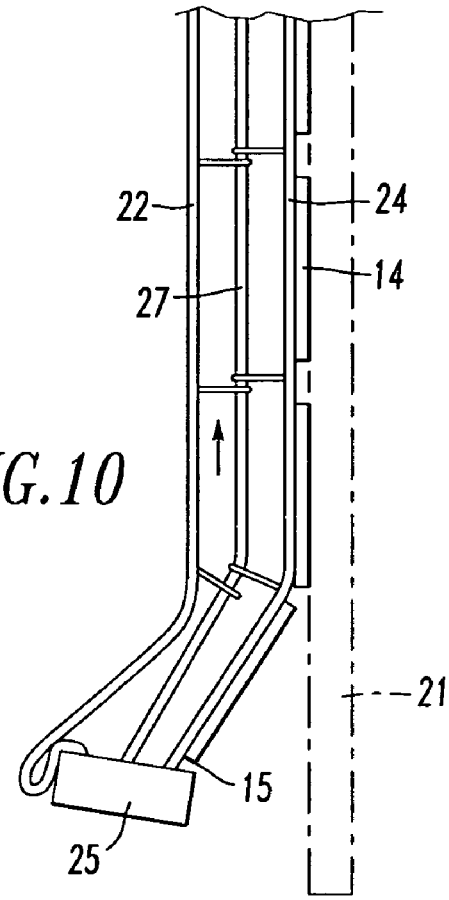
FIG. 10
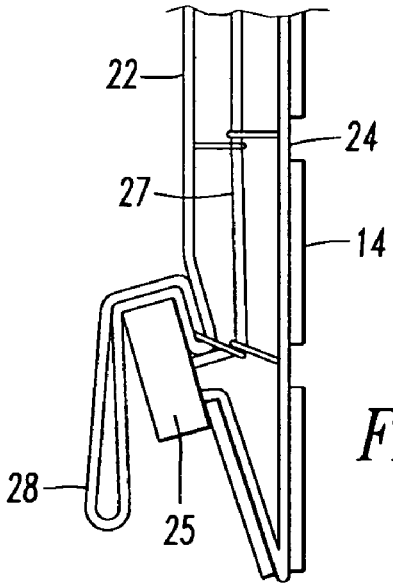
FIG. 11

FIG. 12
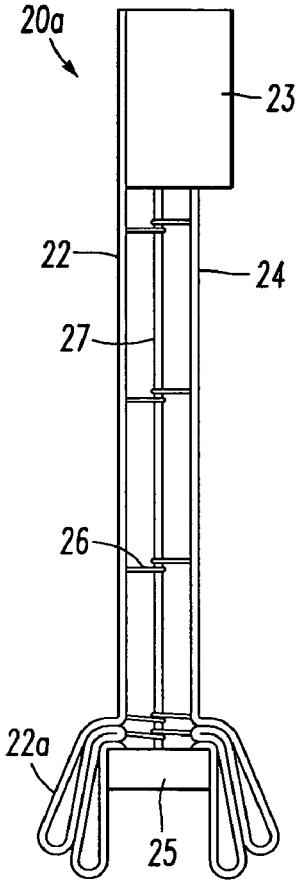
FIG. 14
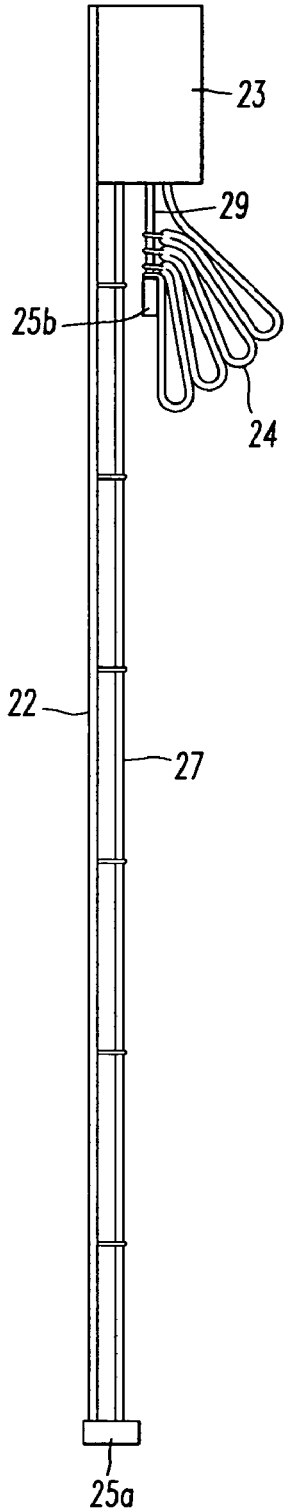
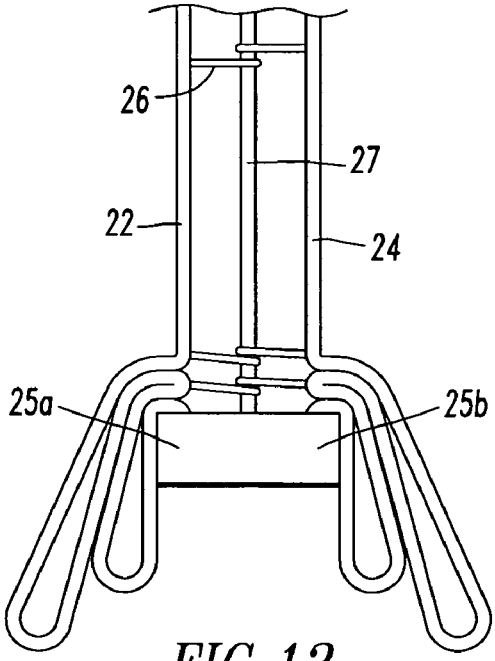
FIG. 13

ROMAN SHADE WITH LINER

CROSS REFERENCE TO RELATED APPLICATION

This application claims priority from U.S. Provisional Patent Application Ser. No. 60/445,862, filed Feb. 10, 2003.

FIELD OF INVENTION

The invention relates to roman shades of the type having a front panel and a liner between the front panel and the window.

BACKGROUND OF THE INVENTION

Roman shades are a well-known window covering in which a sheet of fabric having horizontal rear pleats or tabs is hung from a headrail. Lift cords run down the back of the fabric sheet through the rear tabs or pleats. Sometimes rings or clips are used to attach the lift cords to the tabs or pleats. The lower ends of the lift cords are attached to the fabric at a selected distance above the bottom edge of the fabric. Typically, there is a bottom bar across the lower edge of the fabric sheet. The fabric that extends below the connection points of the lift cords to the bottom bar is called the skirt. In most roman shades the distance between all adjacent pleats or tabs is the same. Frequently, that distance is four, five or six inches. Should the length of a window opening not be a multiple of the distance between tabs, a skirt of a different length is provided. For example, if a window is 54 inches high and the tab spacing is five inches, then a four inch skirt or a nine inch skirt would be provided. If the shade is being custom made the fabricator could make the spacing 5.4 inches. If several roman shades are being installed in one room having windows of different length then all shades are made with the same spacing between pleats and skirts are used as needed for some or all windows. One could make the spacing between pairs of adjacent tabs different. But, such different fabric lengths often cause the folds to jam and stack poorly.

Roman shades commonly have liners adjacent to the back side of the front panel. The liner may be attached to the same bottom bar as the face fabric or may have a separate bottom bar. When the roman shade is raised from a lowered position to a raised position a series of loops will be formed in the face fabric and the liner FIG. 1 is a side view of one type of roman shade 1 which was available in the marketplace many years ago. That roman shade has a shade fabric or face fabric 2 extending from a headrail 3 and a liner 4 attached to the rear surface of the face fabric 2. Both the face fabric and the liner are attached to a common bottom bar 5. Lift cords 7 pass through ring or tabs 9 extending from the liner 4 and are also attached to the bottom bar 5. When the roman shade 1 is raised to any extent the lower portion 6 of the front sheet will face toward the window and be exposed to sunlight, indicated by arrows 8. Over time this exposed lower portion 6 of the face fabric 2 will become faded by the sun. When that occurs and the shade is fully lowered one standing in front of the shade will see a light faded region across the lower edge of the shade.

Another prior art roman shade 10 shown in FIG. 2 is similar to the shade in FIG. 1 but the lift cords 7 are attached to the tab 11 at the top of the skirt 12 rather than the bottom bar 5. The liner 4 should prevent fading of the skirt 12 which extends between tab 9*a* and bottom bar 5. In this roman shade 10 the skirt 12 extends below the first loop of fabric 11. Sometimes the skirt of a roman shade, whose length is determined by the size of the window, is shorter than the first loop of fabric 11, as in the roman shade 10*a* shown in FIG. 3. Fading of the front layer 2 can occur when the skirt is shorter than the first loop of fabric 11. One solution to that problem is to make the skirt longer as in roman shade 10*b* shown in FIGS. 4 and 5. The longer skirt 12*a* would have a length equal to the short skirt 12 in FIG. 7 plus the distance between adjacent tabs 9. That length would be nine inches in the 54 inch shade example mentioned above. However, using a longer skirt 12*a* extends the length of the blind in the raised position shown in FIG. 5.

It is also known to put magnets along the edges of a liner or vapor barrier in window coverings including roman shades. In the prior art roman shade 10*c* shown in FIG. 6 magnets 14 are positioned along the edges of the liner 4. In the past the lift cords 7 have been positioned on the same side of the liner 4 as the magnets 14. The lift cords 7 are inboard of the line of magnets 4 that are located along opposite edges of the liner. When the lift cords 7 are pulled up as in FIG. 8, the magnets 14 tend to slide up the window frame rather than cleanly separate. This can be seen from a comparison of FIGS. 7 and 8. The sliding magnets may tend to jam as the liner moves upward. Because the lift cords 7 are spaced apart from the magnets 14 twisting or torsion can occur across the liner. Another problem than can occur results from the build up of moisture on those liners which act a moisture barrier. The moisture can accumulate causing the magnets to rust. The moisture can migrate to the face fabric causing wet spots and discoloration.

SUMMARY OF THE INVENTION

I provide a roman shade with liner having a headrail, a bottom bar spaced apart from and parallel to the headrail and a face material extending from the headrail and attached to the bottom bar. I further provide a liner extending from the headrail and attached to the bottom bar, the liner having an inside surface facing the inside surface of the face material so as to define a gap between the liner and the bottom bar A plurality of lift cords are attached to the bottom bar, pass through the gap and extend into the headrail. Each lift cord engages a set of tabs, rings or other cord connectors attached to the inside surface of the face material. Preferably, each lift cord also engages cord connectors on the inside surface of the liner. The face material and the liner are each a material that will form loops that extend below the bottom bar as the bottom bar is raised. The face material and liner are sized and configured so that no loop of face material will extend beyond at least one loop of liner material. Consequently, the liner will block sunlight from the face material when the shade is fully raised or partially raised.

I prefer to provide a first set of magnets attached to the liner along a first line parallel to and adjacent the left outer edge of the liner and second set of magnets attached to the liner along a second line parallel to and adjacent the right outer edge of the liner. I also prefer that one lift cord be in a first plane that is parallel to the left edge of the liner and passes through the first line and a second lift cord be in a second plane that is parallel to the right edge of the liner and passes through the second line. When the magnets and lift cords are so positioned the magnets will peel away from the window frame rather than slide up the frame as the shade is being raised.

I prefer to provide a headrail for the shade which has an elongated body having two insert cavities. The liner is attached to one insert. A portion of that insert is within one insert cavity and is removable from the insert cavity. The face material is attached to the second insert. That insert is placed within the second insert cavity. The inserts allow easy removal and replacement of the liner or face material. This headrail can be used with any window covering having a face material and a liner.

Other objects and advantages of the present invention will become apparent from a description of certain present preferred embodiments thereof shown in the drawings.

BRIEF DESCRIPTION OF THE DRAWINGS

FIG. 4 is a side view of another prior art roman shade similar to the roman shades shown in FIGS. 2 and 3 in a partially raised position.

FIG. 5 a side view of the prior art roman shade shown in FIG. 4 in a fully raised position.

FIG. 6 is a rear view of yet another prior art roman shade in a fully lowered position.

FIG. 9 is a side view of a present preferred embodiment of the roman shade with liner of the present invention in a fully lowered position.

FIGS. 10, 11 and 12 are side views of the lower portion of a shade similar to the embodiment of FIG. 9 with or without magnets illustrating how the face material, liner and magnets move as and the shade is being raised.

FIG. 13 is a side view similar to FIG. 12 of a second present preferred embodiment in which the bottom bar has two separable portions.

FIG. 14 a side view of a third present preferred embodiment having a two portion bottom bar, each portion having separate lift cords.

DESCRIPTION OF THE PREFERRED EMBODIMENTS

Figure 1:
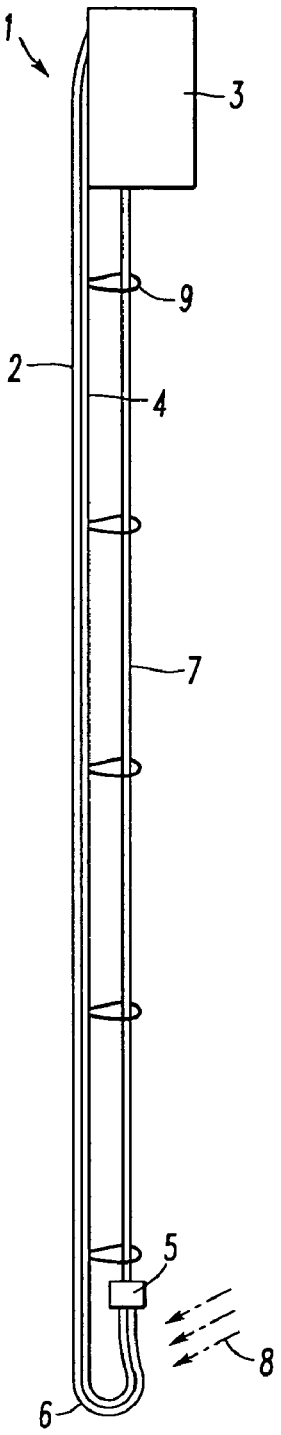
FIG. 1 PRIOR ART
FIG. 1 is a side view of a prior art roman shade in a partially raised position.
Figure 2:
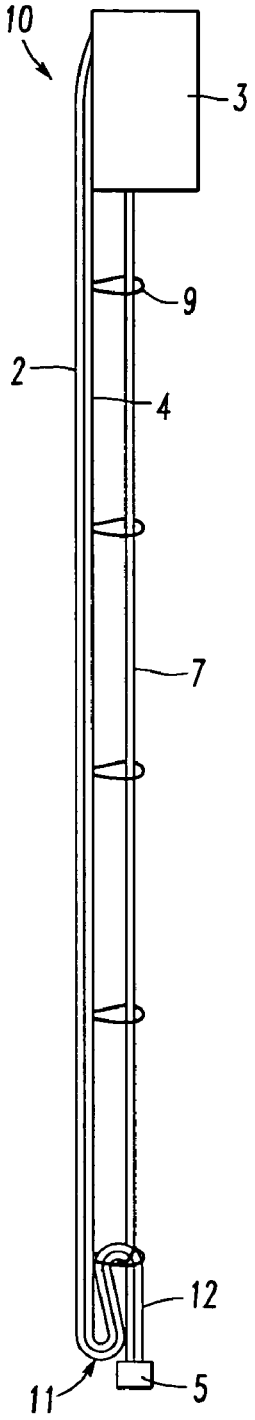
FIG. 2 PRIOR ART
FIG. 2 is a side view of another prior art roman shade in a partially raised position.
Figure 3:
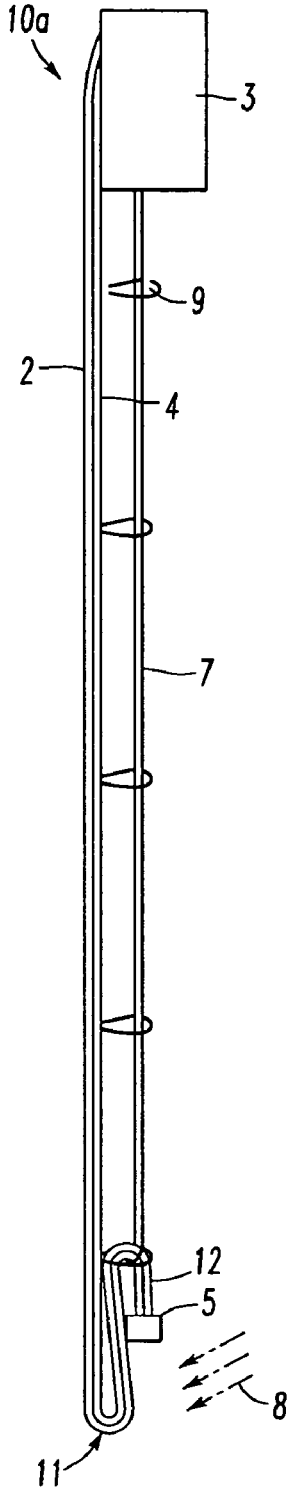
FIG. 3 PRIOR ART
FIG. 3 is a side view of a prior art roman shade similar to the roman shade shown in FIG. 2 in a partially raised position.
Figure 7:
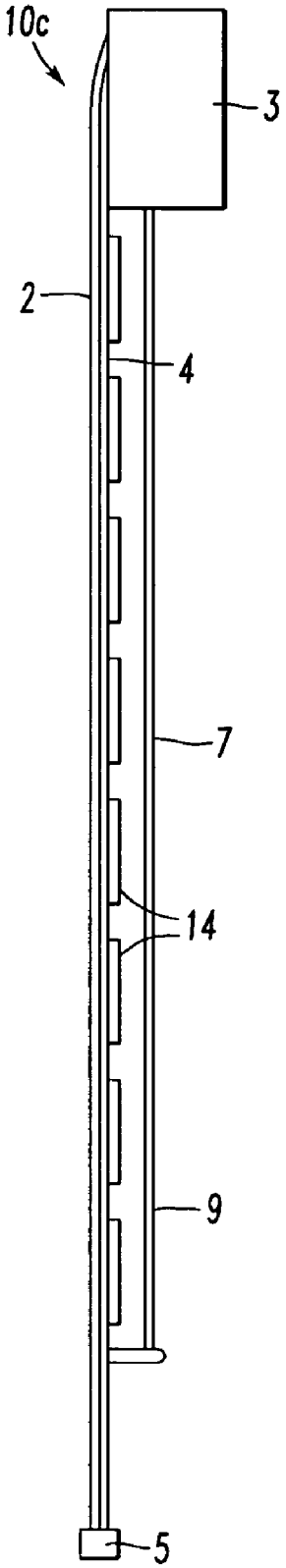
FIG. 7 PRIOR ART
FIG. 7 is a side view of the prior art roman shade shown in FIG. 6.
Figure 8:
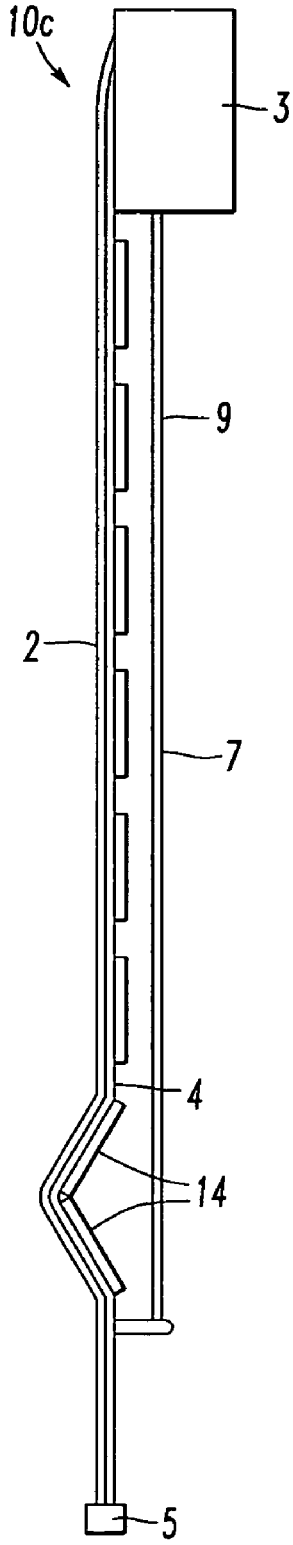
FIG. 8 PRIOR ART
FIG. 8 is a side view of the prior art roman shade shown in FIGS. 6 and 7 as the shade begins to be raised.
Figure 15:
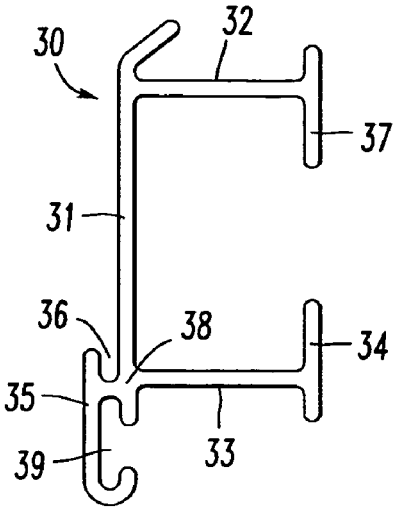
FIG. 15 is a side view of a present preferred headrail that can be used in any of the embodiments of my roman shade with liner.
Figure 16:
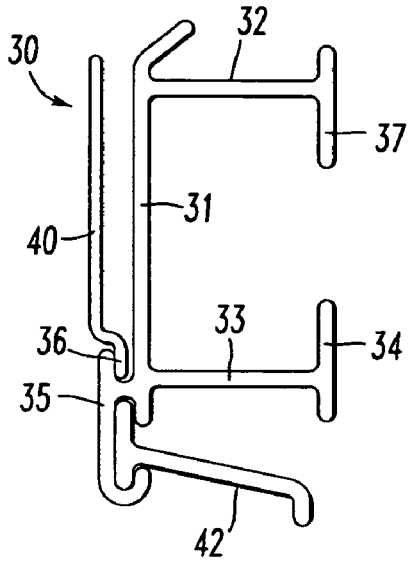
FIG. 16 is a side view of the headrail of FIG. 15 containing an insert for the face material and insert for the liner.

Referring to FIGS. 9, 10 and 11, I provide a roman shade 20 having a front face material 22 and a liner 24 extending from headrail 23 and attached to a common bottom bar 25. The face material could be any material that has been used for roman shades including woven fabrics, non-woven fabrics, woven woods and films. The liner could be any of these materials, but usually would be a less expensive non-woven fabric or film. Lift cords 27 run between the face material 22 and the liner 24 through tabs, rings or other cord connectors 26 attached to the face material or to the liner. A first set of magnets 14 can be attached to the liner along a first line parallel to and adjacent the left outer edge of the liner. A second set of magnets is similarly attached to the liner along a second line parallel to and adjacent the right outer edge of the liner. Preferably one lift cord 27 is behind each line of magnets 14 rather than all lift cords 27 being inboard the magnets 14 as shown in the prior art shade 10*c* of FIG. 6. Then there will be a plane that is parallel to the left edge of the liner and passes through one lift cord and the first line of magnets and a second plane that is parallel to the right edge of the liner and passes through another lift cord and the second line of magnets. The magnets 14 should be flexible strip magnets. Referring to FIG. 10, when the lift cords 27 are raised the lower edge 15 of the lowest magnet is peeled away from the window frame 21, shown in dotted line in the drawing. Because the force provided by the lift cords being raised is applied to the bottom of the magnet, the magnet does not slide as occurs in prior art shades, but pulls away from the window frame. Continued pulling of the lift cords causes the liner to form a first loop 28 as shown in FIG. 11. This same magnet and cord arrangement can be used in other window coverings having liners, not just on roman shades, and even on window coverings having a single panel of material.

The roman shade of the present invention may have magnets as in the embodiment 20 in FIG. 9 or may not contain magnets as in the roman shade 20*a* in FIG. 12. Whether or not magnets 14 are provided on the liner 24, the shade 20 will fold as shown in FIG. 12 as the lift cords 27 are pulled upward. The face fabric and the liner are each a material that will form loops that extend below the bottom bar as the bottom bar is raised. As can be seen in FIG. 12, the liner 24 will form loops 24*a* facing the window and the face fabric 22 will form separate loops 22*a* facing the room. All the loops could be the same size. However, it is likely that the first loop will be longer (as in FIG. 12) or shorter (as in FIG. 13) than the subsequently formed loops. In any event, the face material and liner are sized and configured so that in any raised position there is always one loop of liner 24*a* that extends at least as low as every loop of face material 22*a*. When the shade 20 is fully raised the length of the shade will be less than the length of fully raised prior art shades such as the roman shade 10*b* shown in FIG. 5 in which the liner 4 and the face fabric 2 are in common loops. Another advantage of the shade shown in FIGS. 9 through 12 is that the face fabric 22 is never exposed to direct sunlight. The liner 24 extends to the bottom of the face fabric when the shade is fully lowered as in FIG. 9. When the shade 20 is raised the loops 24*a* of liner 24 block the sun from striking the loops 22*a* of face fabric 22. This is true whether the first formed loops are shorter, longer or the same as subsequently formed loops. Consequently, the present shade is suitable for any size window.

In the embodiments shown in FIGS. 9 through 12 the liner 24 and the face fabric 22 are attached to the same bottom bar. In the embodiment illustrated in FIG. 13, the bottom bar has a first portion 25*a* attached to the face fabric 22 and a second portion 25*b* attached to the liner 24. Both portions can be attached to a common set of lift cords 27 as in FIG. 13. It is also possible to make bottom bar portions 25*a*, 25*b* detachable from one another and to provide separate sets of lift cords 27, 29 for each portion as in the embodiment of FIG. 14. When the two portions 25*a*, 25*a* are detached the liner 24 may be separately raised by lift cords 29 while the face fabric 22 remains in a lowered position as shown in the drawing. Conversely, the face material 22 could be raised by lift cords 27 while the liner remains 24 fully lowered. The face material and liner must be raised and lowered together when a single set of lift cords is used or when the two bottom portions 25*a* and 25*b* are connected together.

Figure 17:
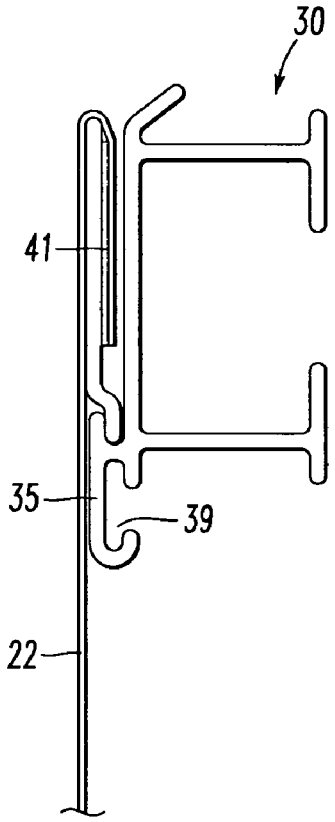
FIG. 17 is a side view of the headrail of FIG. 15 to which the face material insert and face material have been attached.
Figure 18:
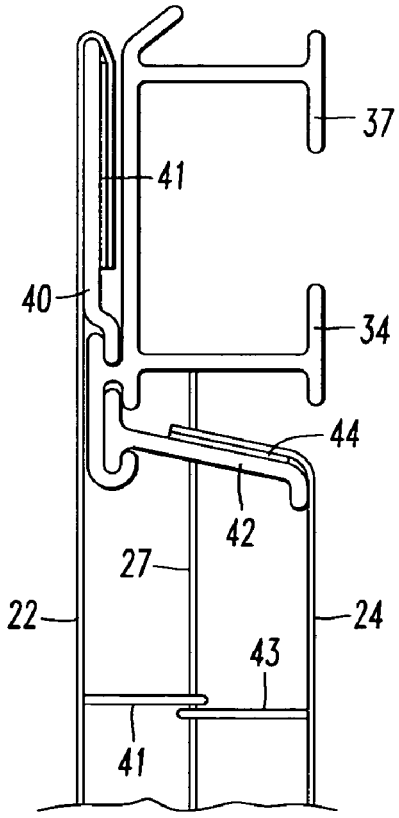
FIG. 18 is a side view of an upper portion of the embodiment shown in FIGS. 9 through 12 on the headrail shown in FIGS. 15, 16 and 17.

The preferred headrail to be used for this shade is shown in FIGS. 15 through 18. The headrail 30 has an elongated body. The headrail has a front wall 31, a top 32 to which an upper rear wall 37 is attached, a lower rear wall 34 and a bottom 33 extending between the front wall and the lower rear wall. A bracket portion 35 extends from the corner 38 of the front wall 31 and the bottom 33. The bracket 35 forms a first cavity or slot 36 that receives a fabric insert 40. The face fabric 22 can be attached to the fabric insert 40 using an adhesive as shown in FIGS. 17 and 18. The bracket 35 has a second cavity or slot 39 which receives an insert 42 to which the top edge of the liner 24 is attached. As shown in FIG. 18 the top edge of the liner 24 is preferably attached to the insert by a strip of adhesive 44. The adhesive could be a double-coated tape which has an adhesive on both sides of the tape. In a preferred method of installing the liner, the fabricator takes the insert 42 separate from the headrail 30 and applies a strip of double sided adhesive tape 44 to the insert 42. Then he presses the top edge of the liner 24 against the adhesive tape 44 on the insert 42. Next he slides the insert 42 into the cavity 39 beginning at one end of the headrail 30, moving the insert across the headrail 30 until the insert is in its proper place. If desired, the tape 44 could be placed on the liner 24 rather than the insert 42. Use of the insert 42 for the liner 24 allows not only easy assembly at the fabricator's facility but also makes it easy to change liners in the field. Those skilled in the art will recognize that this headrail could be used for window coverings other than roman shades. Furthermore, one could attach either the face material or the liner directly to the headrail without using an insert.

In the embodiment of FIGS. 15 through 18, the face fabric 22 and the liner 24 may have roman folds. Tabs or rings 41, 43 on the inside surfaces of the face material 22 and the liner 24 face inward towards one another as shown. The lift cords 27 pass through the tabs or rings 41, 43. This arrangement allows the to face fabric 22 and the liner 24 to fold in loops similar to what is shown in FIG. 12.

In a preferred embodiment of the shade shown in FIG. 12 the face fabric 22 is a white or off-white lace and the liner 24 is a solid color such a dark blue. The spacing of the liner 24 from the see-through face layer 22 gives depth to the shade.

Spacing the face fabric from the liner as in FIGS. 9, 12 and 18 provides advantages when the liner is a moisture barrier. Should moisture build up and accumulate on the liner the spacing between the liner and the face fabric prevents migration of that water to the face fabric.

While the present invention has been described and shown as a roman shade and a liner in which the face material and the liner have no pleats, the invention is not so limited. There are many fabrics in which a roman shade appearance can be obtained by providing pleats, which may be called soft pleats for some materials. There are also some cellular fabrics that will provide a roman shade appearance. The face fabric can be transparent or semi-transparent material. The liner preferably is opaque or semi-opaque.

Although I have shown and described certain present preferred embodiments of my roman shade with liner it should be distinctly understood that the invention is not limited thereto, but may be variously embodied within the scope of the following claims.

I claim:

1. A roman shade with liner comprising:

a headrail;

a bottom bar spaced apart from and parallel to the headrail;

a face material extending from the headrail and attached to the bottom bar, the face material having an inside surface and having a plurality of cord connectors on the inside surface;

a liner extending from the headrail and attached to the bottom bar, the liner having an inside surface and a plurality of cord connectors on the inside surface, the inside surface of the liner facing the inside surface of the face material so as to define a gap between the liner and the bottom bar; and a plurality of lift cords each lift cord attached to the bottom bar, passing through the gap, engaging at least one cord connector and extending into the headrail wherein the face material and the liner are each a material that will form loops that extend below the bottom bar as the bottom bar is raised and the face material and liner being sized and configured so that no loop of face material will extend beyond at least one loop of liner material.

2. The roman shade of claim 1 wherein the liner and the face material are each a material selected from the group of materials consisting of woven fabrics, non-woven fabrics, woven woods and films.

3. The roman shade of claim 1 wherein the liner has a left outer edge and a right outer edge and also comprising a first set of magnets attached to the liner along a first line parallel to and adjacent the left outer edge and second set of magnets attached to the liner along a second line parallel to and adjacent the right outer edge.

4. The roman shade of claim 3 wherein one of the plurality of lift cords is in a first plane that is parallel to the left edge of the liner and passes through the first line and a second one of the plurality of lift cords is in a second plane that is parallel to the right edge of the liner and passes through the second line.

5. The roman shade of claim 1 wherein the cord connectors are tabs or rings.

6. The roman shade of claim 1 wherein each lift cord of the plurality of lift cords engages at least one cord connector on the liner and at least one cord connector on the face material.

7. The roman shade of claim 1 wherein the headrail is comprised of:

an elongated body having a first cavity; and a first insert to which the face material is attached, a portion of the first insert being within the first cavity.

8. The roman shade of claim 7 also comprising an adhesive attaching the face material to the first insert.

9. The roman shade of claim 7 wherein the elongated body has a second cavity and further comprising a second insert to which the liner is attached, a portion of the second insert being within the second cavity.

10. The roman shade of claim 9 also comprising an adhesive attaching the liner to the second insert.

11. The roman shade of claim 10 wherein the adhesive is double-coated tape.

12. The roman shade of claim 1 wherein the headrail is comprised of:

an elongated body having an insert cavity and an insert to which the liner is attached, a portion of the insert being within the insert cavity.

13. The roman shade of claim 12 also comprising an adhesive attaching the liner to the insert.

14. The roman shade of claim 13 wherein the adhesive is double-coated tape.

15. A window covering comprising:

a headrail;

a bottom bar spaced apart from and parallel to the headrail;

a window covering material extending from the headrail and attached to the bottom bar, the window covering material having a left outer edge and a right outer edge, a first plane passing through the left outer edge and a second plane passing through the right outer edge such that the first plane is parallel to the second plane;

a plurality of lift cords each lift cord attached to the bottom bar and extending past the window covering material and into the headrail;

a first set of magnets attached to the window covering material along a first line parallel to and adjacent the left outer edge;

a second set of magnets attached to the window covering material along a second line parallel to and adjacent the right outer edge; and wherein one of the plurality of lift cords is in a plane that is parallel to the first plane and passes through the first line and a second one of the plurality of lift cords is in a plane that is parallel to the second plane and passes through the second line.

16. A window covering comprising:

a headrail;

a bottom bar spaced apart from and parallel to the headrail;

a window covering material extending from the headrail and attached to the bottom bar, the window covering material having a left outer edge and a right outer edge wherein the window covering material is comprised of a face material having an inside surface and a liner having an inside surface and a plurality of cord connectors on the inside surface of at least one of the facing material and the liner, the inside surface of the liner facing the inside surface of the face material so as to define a gap between the liner and the face material;

a plurality of lift cords attached to the bottom bar passing through the gap, engaging at least one cord connector and extending past the window covering material and into the headrail;

a first set of magnets attached to the liner along a first line parallel to and adjacent the left outer edge;

a second set of magnets attached to the liner along a second line parallel to and adjacent the right outer edge; and wherein one of the plurality of lift cords is in a plane that is parallel to the left edge of the window covering material and passes through the first line and a second one of the plurality of lift cords is in a plane that is parallel to the right edge of the window covering material and passes through the second line.

* * * * *